340-566 SR
11/10/87 XR 4,706,069

United States Patent [19]

Tom et al.

[11] Patent Number: 4,706,069

[45] Date of Patent: Nov. 10, 1987

[54] SECURITY SYSTEM

[75] Inventors: Edward Tom, Philadelphia, Pa.; Douglas E. McGovern, Albuquerque, N. Mex.

[73] Assignee: RCA Corporation, Princeton, N.J.

[21] Appl. No.: 849,491

[22] Filed: Apr. 8, 1986

[51] Int. Cl.[4] ..... G08B 13/00

[52] U.S. Cl. ..... 340/541; 340/565; 340/566

[58] Field of Search ..... 310/800; 340/565, 566, 340/567, 541

[56] References Cited

U.S. PATENT DOCUMENTS

| | | | |
|---|---|---|---|
| 3,005,191 | 10/1961 | Schmidt | 340/514 |
| 3,409,886 | 11/1968 | Davis et al. | 340/550 |
| 3,518,654 | 6/1970 | Vassil | 340/562 |
| 3,633,194 | 1/1972 | Kothe | 340/550 |
| 3,912,830 | 10/1975 | Murayama et al. | 310/800 |
| 3,925,763 | 12/1975 | Wadhwani et al. | 340/505 |
| 4,052,716 | 10/1977 | Mortensen | 340/567 |
| 4,385,287 | 5/1983 | Eatwell | 340/537 |
| 4,419,599 | 12/1983 | Micheron | 310/800 |
| 4,490,639 | 12/1984 | Echols et al. | 310/800 |

OTHER PUBLICATIONS

RCA Features, vol. 3, No. 1, RCA Aerospace and Defense, Cherry Hill, N.J. 03858, Jan./Feb. 1986, p. 2.

Model SYS300 Data Sheet, *Interstate Electronics Corporation*, 1982.

*Primary Examiner*—Stewart J. Levy
*Assistant Examiner*—Hezron E. Williams
*Attorney, Agent, or Firm*—Clement A. Berard, Jr.; William H. Meise

[57] ABSTRACT

A security system is disclosed which senses a variety of activities which affect a secured area and/or the boundary which defines it and identifies particular activities rather than merely indicating that some activity is present. A transducer comprising an electroded ferroelectric film of polyvinylidene fluoride (PVDF) serves as a transducer which provides different output signals in response to different stimuli and responds simultaneously to thermal and mechanical activity. A signal processor separately recognizes the signals produced in response to different activities and identifies the activities detected. An alarm processor controls the system and generates alarm signals in response to the detection of specific activities.

10 Claims, 15 Drawing Figures

SECURITY SYSTEM

The present invention relates to security systems for sensing intrusion into a secured area and more particularly for sensing and classifying activity which affects the secured area or its boundaries.

Many different systems have been developed to detect intrusion into a secured area. These include tape or painted conductors on window panes to detect broken glass, magnetic sensors for detecting the opening of doors and windows, light beam and sonic systems for detecting movement within a secured area and closed circuit television systems for remote observation of a secured area. Each of these systems has disadvantages. The conductive tape on window panes system can be circumvented if a portion of the window glass which is not taped can be removed without cracking the window glass which is taped. The magnetic door or window sensors can be circumvented by cutting through the door or the surrounding wall or by removing a piece of glass from the window to gain access without opening the protected door or window.

Further, all of these systems are largely ineffective for detecting attempts at intrusion before the intruder actually gains access to the secured area. None of these systems is responsive to the activity of the intruder prior to the actual breakthrough, such as using heat to burn his way into the secured area.

A security system is needed which detects physical activity including temperature changes which affect a secured area or its boundary and classifies the electrical signals caused by those activities to provide unattended identification of the activity being detected.

SUMMARY OF THE INVENTION

The present invention satisfies this need by detecting, classifying and identifying activity affecting a secured area or the boundary which defines that area. That boundary may be a wall or a secured floor area or other structure having major boundary surfaces. A preferred transducer comprises a ferroelectric film or slab of polyvinylidene fluoride (PVDF) with first and second opposed major surfaces having, respectively, first and second electrodes deposited thereon. The transducer is disposed in thermal and acoustic contact with a portion of the boundary to be secured in order to transduce activities (both thermal and mechanical) affecting that boundary into corresponding electrical signals. Each distinct activity of interest produces a corresponding electrical signal whose waveform is distinct from the waveforms of the electrical signals which correspond to other activities. A signal processor responds to the waveforms of these electrical signals to separately recognize different waveforms to detect the occurrence of the corresponding activities and produces an output signal identifying the individual activities whose occurrence it detects. An alarm processor provides system control and generates alarm signals in response to identification of particular activities.

DETAILED DESCRIPTION

Figure 1:
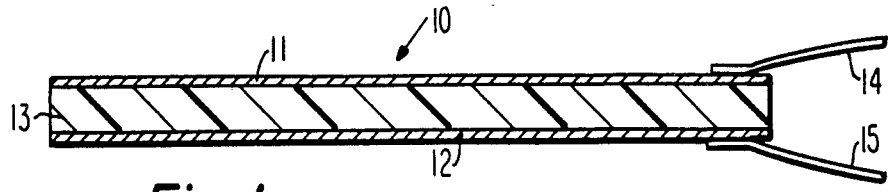
FIG. 1 illustrates a preferred transducer in accordance with the present invention.

A preferred transducer 10 in accordance with the invention in FIG. 1 comprises a ferroelectric film or slab 13 of polyvinylidene fluoride (PVDF) having first and second opposed major faces and first and second thin electrodes 11 and 12, respectively, deposited on those major faces. Electrodes 11 and 12 may be nickel, aluminum, silver or other appropriate electrically conductive materials and have external leads 14 and 15, respectively, extending therefrom as the leads of the transducer. These leads may be attached to the deposited electrodes 11 and 12 by first soldering the lead to a piece of copper conductive tape or foil and then attaching the copper tape or foil to the electrode 11 or 12 using TRA-DUCT 2902 silver filled epoxy. TRA-DUCT 2902 is a trade name of TRA-CON, Inc.

The PVDF film or slab is made ferroelectric before the electrodes are deposited thereon. As a ferroelectric, the film 13 has both piezoelectric and pyroelectric characteristics and transducer 10 will provide an electrical signal in response to changes in the temperature of the PVDF film or the pressure on the PVDF or both. Ferroelectric PVDF film is commercially available from a number of sources. One such source is Pennwalt Corporation, Plastics Department, Three Parkway, Philadelphia, Pa. 19102, which sells it under the trade name KYNAR film.

This transducer responds to thermal stimuli due to the pyroelectric effect in accordance with:

$$V=(A/F)\lambda\Delta\theta(\text{volts})$$

and $$I=A\lambda(d\theta/dt)\ (\text{nanoamps}),$$

and responds to pressure due to the piezoelectric effect in accordance with:

$$\Delta Q=A\ d_H\Delta H\ (\text{picocoulombs})$$

and $$\Delta V=Z\ g_H\Delta H\ (\text{millivolts}),$$

where:

$A$ = area in meters$^2$
$F$ = capacitance in picofarads
$\Delta\theta$ = temperature change in ° K
$d\theta/dt$ = rate of temperature change ° K/second
$\Delta H$ = pressure change in Pascals and Z=thickness of the PVDF in meters.

λ=pyroelectric coefficient and is 18 microcoulombs/meter$^{2}$-° K and $g_H$ and $d_H$ are piezoelectric coefficients and $g_H = -0.282$ volts/meter-Pascals and $d_H = -20$ picocoulombs/Newton.

Figure 2:
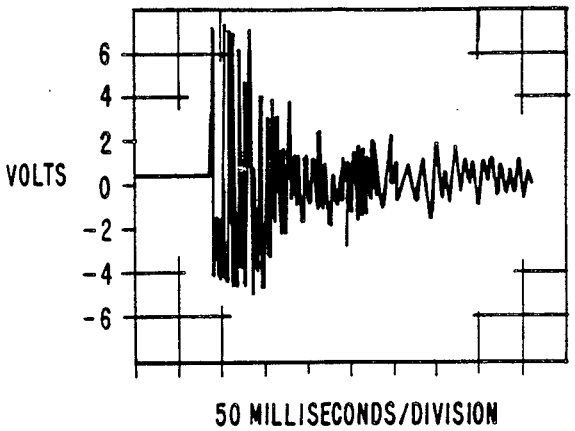
FIGS. 2–7 are photographs of oscilloscope traces of the electrical waveforms produced by the transducer of FIG. 1 in response to a variety stimuli.
Figure 3:
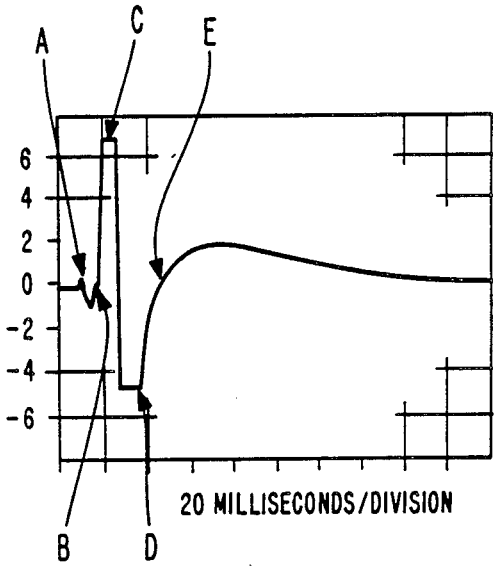
Figure 4:
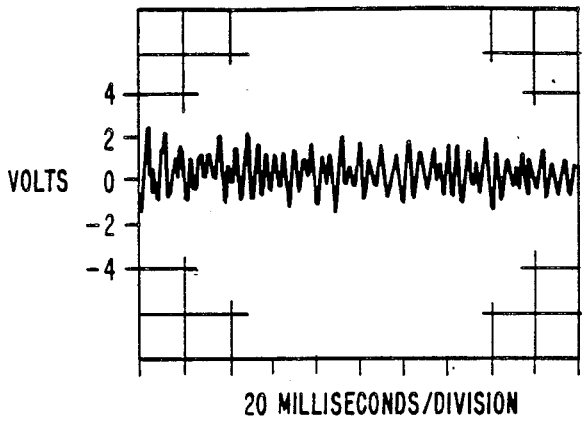
Figure 5:
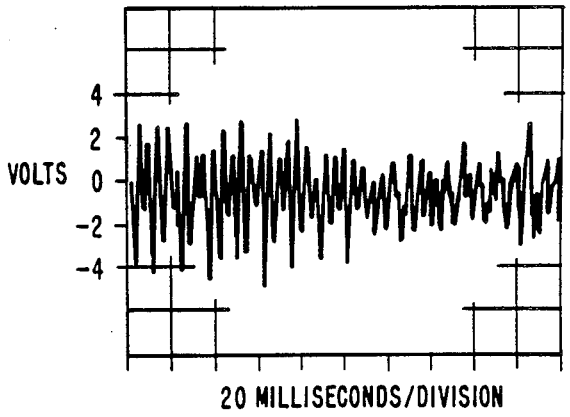
Figure 6:
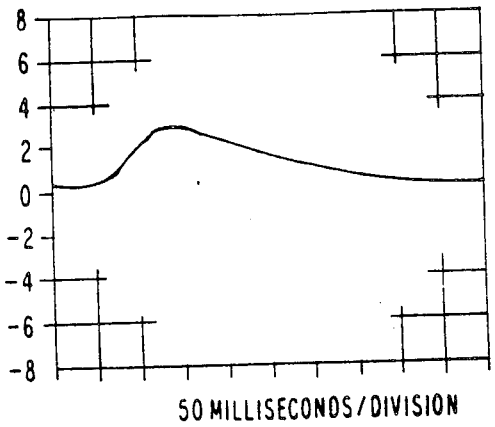
Figure 7:
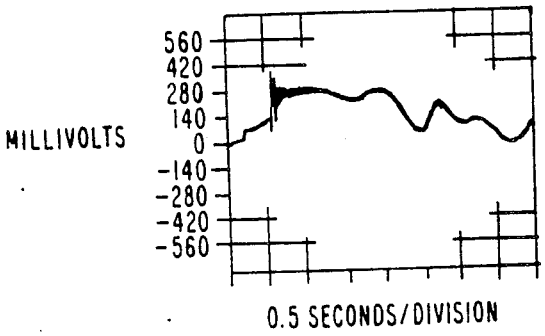

FIGS. 2–7 are photographs of oscilloscope traces of the (amplified) electrical waveforms produced by a 2 inch by 4 inch transducer 10 having a 110×10-6 meter thick PVDF film in response to a variety of stimuli. FIG. 2 is the waveform produced by transducer 10 when the far side of a sample portion of a steel wall is struck with a hammer. The oscilloscope vertical scale is 2 volts per division and the horizontal scale is 50 milliseconds (ms) per division. FIG. 3 is the waveform produced by transducer 10 in response to application of a force at time A followed by removal of that force at time C. The oscilloscope vertical scale is 2 volts per division and the horizontal scale is 20 milliseconds per division. This waveform has zero crossings at substantially times B, C and E. The zero crossings at times B and C are each followed by saturation of the waveform due to the electronics used. At time D the response begins to decay back to zero and does so with a zero crossing at time E since the response overshoots once. This waveform is distinguished from an impact such as that of the hammer shown in FIG. 2 by the long intervals between the zero crossings in this force response as compared to the impact response in FIG. 2. FIG. 4 is the waveform produced by transducer 10 when a rotating drill bit is held against the far side of a steel wall without being pressed against the wall. The oscilloscope vertical scale is 2 volts per division and the horizontal scale is 20 ms per division. FIG. 5 is the waveform produced by transducer 10 when the same rotating drill bit is pressed against the far side of the wall. The oscilloscope scales in FIG. 5 are the same as in FIG. 4. FIG. 6 is the waveform produced by transducer 10 when the transducer itself is heated by passing a match across the face of the transducer 1 inch from the transducer with the transducer oriented with its major face vertical. The oscilloscope vertical scale is 2 volts per division and the horizontal scale is 50 ms per division. FIG. 7 is the waveform produced by transducer 10 when the transducer is heated directly and the far side of a steel wall is struck with a hammer. The oscilloscope vertical scale is 140 millivolts per division and the horizontal scale is 0.5 seconds per division. Other stimuli induce other responses from the transducer.

A PVDF transducer of this type is free of resonances of its own and provides an electrical output signal which faithfully reproduces time varying pressure and thermal stimuli to which it is subjected. Vibrations and impacts affecting the transducer are faithfully reproduced, since they apply a corresponding pressure profile to the transducer.

The security system to be described below takes advantage of the frequency, phase and amplitude differences among the waveforms induced by different activities as a means of classifying the type of activity which is inducing a transducer's output.

Figure 8:
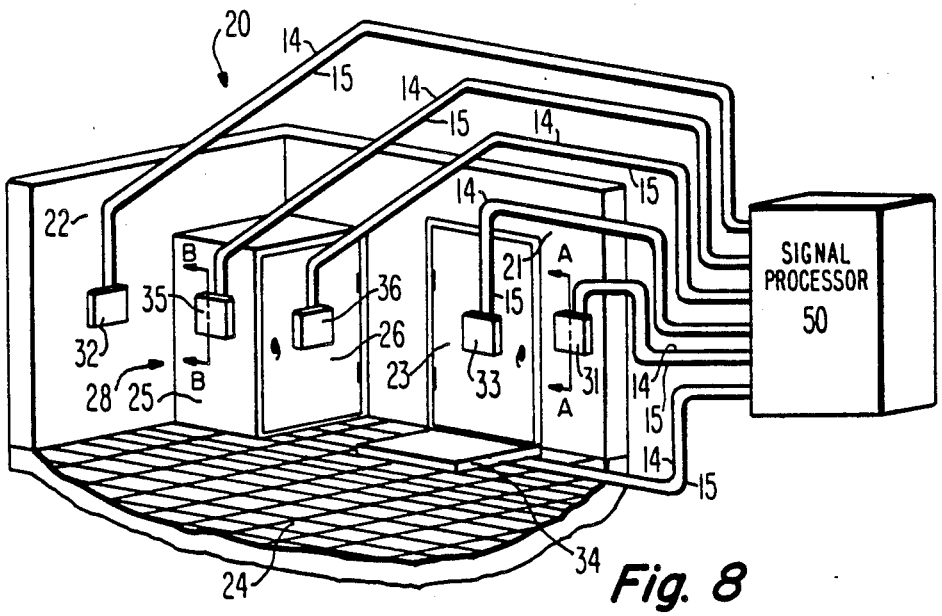
FIG. 8 is a perspective illustration of a security system in accordance with the present invention as applied to a secured room.

FIG. 8 is a cutaway view of a secured area 20 which is protected by a security system in accordance with the present invention. The boundary of the secured area comprises side walls 21 and 22 and a floor 24. In other environments, the boundary may be a fence or other physical barrier protecting the secured area. Wall 21 includes a door 23. A cabinet 28, within the secured area is located in the corner where walls 21 and 22 meet, has an exposed wall 25 and a door 26 and is separately secured. Transducers 31–33 are applied to the interior surface of the walls 21 and 22, and the door 23, respectively, to sense any attempts at intrusion by breaking through those walls and that door. A transducer 34 is disposed on the interior (upper) surface of the floor 24 to sense movement on the floor. The transducer 34 may be placed under a carpet or other floor covering as may be desirable. A transducer 35 is disposed on the exterior surface of the exposed wall 25 of cabinet 28 and a transducer 36 is disposed on the exterior surface of its door 26. Each of the transducers 31–36 is like transducer 10 and is separately connected to a signal processor 50 which processes their output signals to detect and classify activity which affects them. Signal processor 50 is shown in more detail in FIG. 11 and is described in detail below in connection with that FIGURE.

Figure 9:
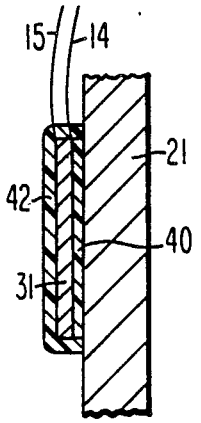
FIG. 9 is a cross section along the line A—A in FIG. 8 through one of the transducers.

The transducer 31 and the wall 21 are shown in cross section in FIG. 9. This is a layered structure comprising wall 21, a layer 40 of adhesive, the transducer 31 and a protective overcoat 42. The structure shown in FIG. 9 is created by coating the wall 21 with the adhesive and then applying the transducer 31 thereto. Thereafter, the overcoat 42 is applied. The adhesive should be thermally and acoustically conductive in order to transmit temperature changes and vibrations in the wall 21 to transducer 31 for transduction into electrical signals. The adhesive may preferably comprise a mixture of Silgrip 6574, Dipropylene Glycol, and Xylol in a weight ratio of 100:2:100. Silgrip 6574 is a trade name of General Electric. Dipropylene Glycol is available from Union Carbide and Xylol is available from Philips and Jacobs. This adhesive may be sprayed on the wall to create the layer 40. The protective overcoat 42, which may be a mixture of NEOREZ960, TYZORAA and CX100 in a weight ratio of 133:1:4. These are trade names of Polyvinyl Chemical Industries, DuPont and Polyvinyl Chemical Industries, respectively. This overcoat is applied over the transducer 31 to protect its surface from scratches, abrasions and chemicals in its environment. Both the adhesive and the overcoat are inert to the PVDF and a nickel metallization thereon. If it is desired to conceal the transducer either for cosmetic or security reasons, the overcoat 42 may have a layer of paint or other wall covering disposed thereover.

The manner in which the transducers 32–34 are applied to wall 22, door 23 and floor 24 is similar to that in which transducer 31 is applied to wall 21.

Figure 10:
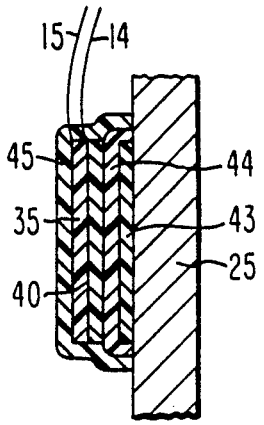
FIG. 10 is a cross section along the line B—B in FIG. 8 through a second one of the transducers.

The transducer 35 and the wall 25 of cabinet 28 are shown in cross section in FIG. 10. This is a layered structure comprising cabinet wall 25, a layer 43 of adhesive, a layer 44 of thermal insulation, a layer 40 of adhesive, the transducer 35 and a protective overcoat 45. The transducer 35 is applied over the exterior surface of wall 25 and thermally insulated therefrom in order to respond to pressure on or heat directed toward the exterior surface of the cabinet. The adhesive layers 40 and 43 are like the layer 40 in FIG. 9. The overcoat 45 is preferably transparent to infrared radiation to enable the transducer 35 to respond to the body heat of an individual in close proximity to the cabinet. The manner in which transducer 36 is applied to cabinet door 26 is similar to that in which transducer 35 is applied to wall 26 in FIG. 10.

Figure 11:
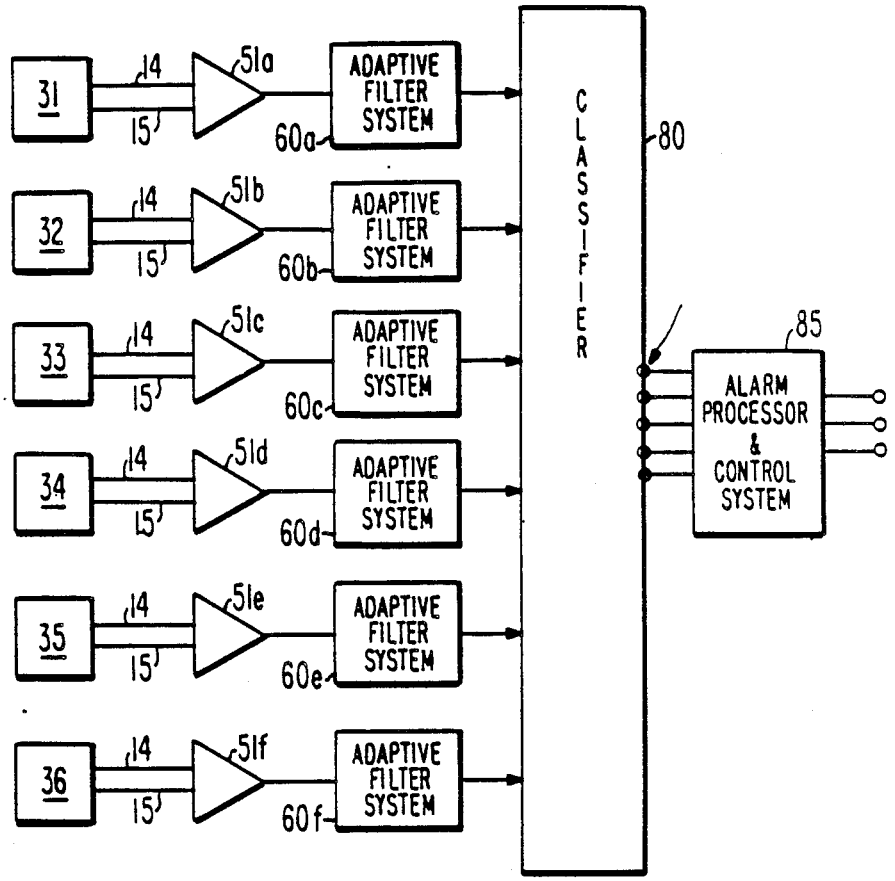
FIG. 11 is a schematic of the signal processor in FIG. 8.
Figure 13:
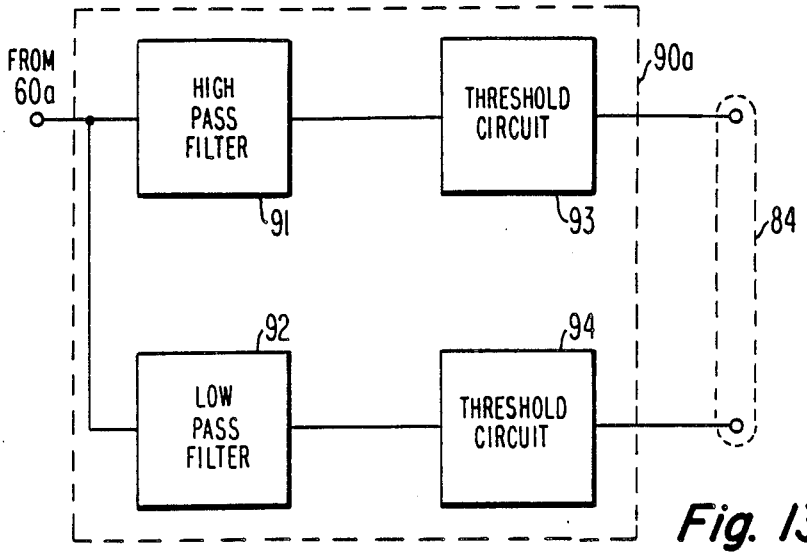
FIG. 13 is a schematic of one embodiment of a classifier usable in the processor of FIG. 11.
Figure 14:
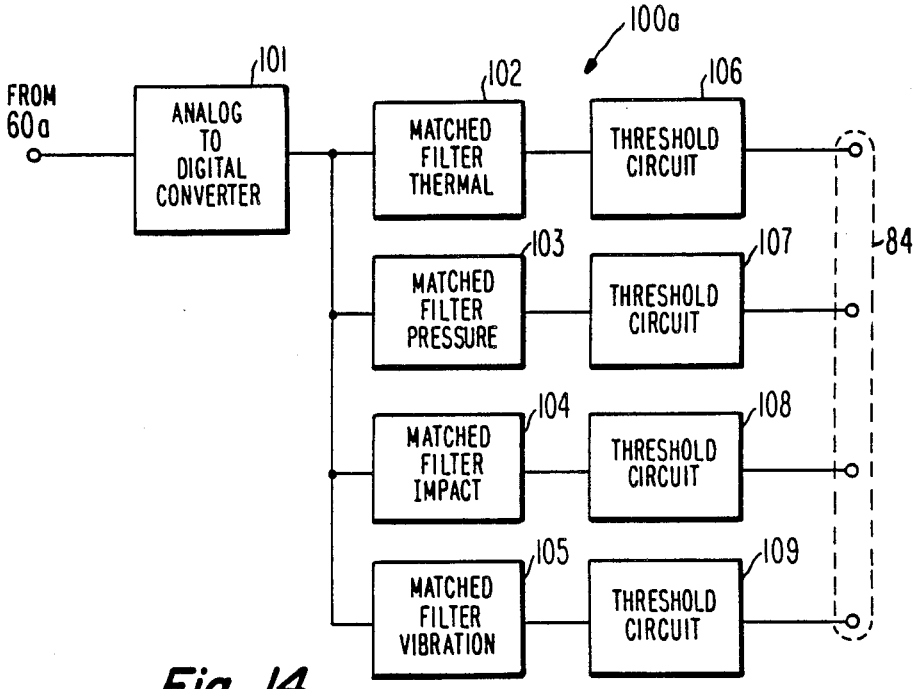
FIG. 14 is a schematic of another embodiment of a classifier usable in the processor of FIG. 11.
Figure 15:
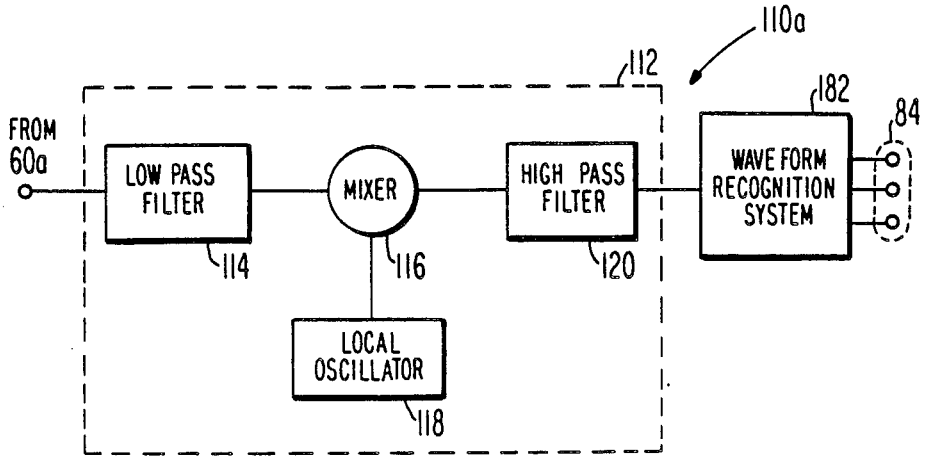
FIG. 15 is a schematic of still another embodiment of a classifier usable in the processor of FIG. 11.

A block diagram of signal processor 50 is shown in FIG. 11. The two leads from each of the transducers 31–36 are connected to a corresponding high input impedance amplifier 51*a*–51*f*, respectively. The amplifiers 51*a*-51*f* are preferably placed close to the transducers to keep each transducer's leads 14 and 15 short. This helps to minimize noise pick up in those leads. The output of each of the amplifiers 51 is connected to the input of a corresponding adaptive filter system 60*a*–60*f*. These adaptive filter systems improve the signal-to-noise ratios of the transducer output signals of interest by subtracting background noise. Adaptive filter system 60*a* is shown in block diagram form in FIG. 12 and is discussed more fully below in connection with that FIGURE. The output signals from the adaptive filter systems 60 are connected to inputs of a classifier 80 which detects and recognizes those signals produced by activities of interest. Classifier 80 may take a number of different forms depending on the degree of refinement desired in the activity classification. Three different embodiments of classifier 80 are illustrated in FIGS. 13–15. They are discussed below in connection with those FIGURES.

If desired, the output of the classifier 80 may serve as the output of the entire security system. However, it is preferred to provide the output from classifier 80 to an alarm processor and control system 85 which responds to the presence of each identified stimulus in a manner which is appropriate to that stimulus. In addition, processor 85 provides overall system control including coordinating the operation of the various portions of the system, as needed.

In many situations, a single impact on a wall, for example by a baseball or a wind-blown object, is not worthy of issuing an alarm. However, a single much heavier impact or sequence of even relatively light impacts should cause an alarm. Any indication of a substantial increase in temperature should provide an immediate alarm because of the dual possibilities of fire and an attempted break-in using a torch. The particular alarm responses to be provided in response to specific detected activities depend on the application of the system and on the intensity of the activity. Sledge hammer blows to a wall are normally more significant than someone's fingers tapping on the wall. A short duration of a vibration which results from passing traffic or other sporadic phenomena is generally not worthy of issuing an alarm, since it is not a threatening activity. However, repeated occurrence of a vibration over a period of time should cause an alarm, as should a long duration of a vibration. Each of these criteria or limits should be set in accordance with the environment in which the system is in use and the security required. Thus, the response of the alarm processor and control system 85 to the detection of specific activities is a matter to be determined and established during the design of the security system and depends on the application.

Classifier 80's output specifies what, if any, activities are presently being detected. This output is preferably a plurality of binary signals, one for each activity. These signals are preferably provided in parallel on a set of output terminals 84, with one of the output terminals dedicated to each activity of interest. When an activity is *not* being detected, the corresponding output line is set at ground voltage or a logic 0. When an activity is being detected the corresponding output line is set at a high voltage or a logic 1. The intensity (amplitude) of each detected activity may also be provided as an output either as part of the signal which identifies what activity is being detected or as a separate signal. In a classifier in which the magnitude of its detection signal varies in accordance with the amplitude of its input signal, this intensity signal can be provided by converting the magnitude of that detection signal into the intensity signal. Where more than one transducer is used, a separate set of classifier output terminals may be provided for each transducer to separately identify where a detected activity is centered.

Figure 12:
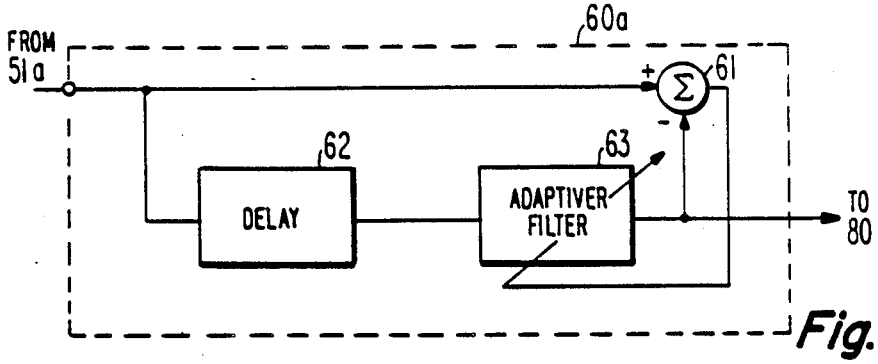
FIG. 12 is a schematic of an adaptive filter usable in the processor of FIG. 11.

Adaptive filter system 60*a* is shown in block diagram form in FIG. 12. This is one of many adaptive filter systems which may be utilized to enhance the signal-to-noise ratio of the waveform which is actually provided to the classifier 80. Other adaptive filter systems may be used if desired. Such adaptive filter systems are described in some detail in reference texts such as "ADAPTIVE SIGNAL PROCESSING" by Bernard Widrow and Samuel Stearns published by Prentice Hall. That text is incorporated herein by reference. The adaptive filter system 60*a* shown in FIG. 12 receives its input from the transducer via amplifier 51*a*. That input is provided to a non-inverting input terminal of a sum circuit 61 and to a delay 62. The output of the delay 62 is provided to the input of an adaptive filter 63 whose output is applied to an inverting input of the sum circuit 61 and as the enhanced output signal from the adaptive filter system 60*a*. The output of the sum circuit 61 is applied to the control input of the adaptive filter 63 for use in adjusting the weights within adaptive filter 63. Adaptive filter systems of this type are well known and their operation is well understood. Ihe inclusion of the adaptive filter system 60*a* in the system 20, is desirable to enhance the signal-to-noise ratio but is not essential in those environments where sufficient signal clarity is present to enable the classifier 80 to identify waveforms corresponding to activities of interest in the absence of the adaptive filtering.

Classifier 80 can take a number of different forms in accordance with the degree of differentiation it is desired to provide among activities.

A coarse signal classifier is illustrated generally at 90*a* in FIG. 13. This classifier 90*a* receives its input signal from the adaptive filtering system 60*a*. That input signal is provided as the input to both a high pass filter 91 and a low pass filter 92. The low pass filter is provided with an upper cutoff frequency of about 5 to 10 Hz in order to pass thermal responses and responses to applications of force which produce slow changes in pressure while blocking impact and vibration responses at frequencies above that cutoff frequency. The high pass filter 91 is provided with a low frequency cutoff in the neighborhood of 5 to 10 Hz in order to pass impact and vibration responses while blocking thermal and force responses passed by low pass filter 92. The output of high pass filter 91 is provided as the input to a threshold circuit 93 which provides a ground voltage or logic 0 output unless the signal received from the high pass filter 91 has an amplitude in excess of a threshold value. This threshold value is set in accordance with the noise level in the system's environment to minimize false alarms without missing alarm situations. In the event that the signal from high pass filter 91 does have an amplitude in excess of the established threshold, then the output signal from threshold circuit 93 is a high voltage or a logic 1. This threshold circuit can be a series combination of a resistor, a rectifier and a holding capacitor with a bleeder resistor across the holding capacitor to prevent long term integration of received signals. The voltage across the holding capacitor is compared to a reference voltage in a comparator. When the voltage across the holding capacitor is greater than the reference voltage, then the output signal from the comparator is a high voltage or a logic 1. Otherwise, the output from the comparator is a low or ground voltage constituting a logic 0.

The output of low pass filter 92 is provided to a threshold circuit 94 which is similar in function to the threshold circuit 93. However, because of the low frequency signals including essentially DC to which the threshold detector 94 must be responsive, the detector 94 must be responsive to both positive and negative signal excursions rather than relying upon a single rectification to combine both types of excursion into a single output signal. This can be done by detecting the magnitude of the signal received by the threshold circuit and proceeding in a manner similar to that described for circuit 93. The outputs from the comparators comprise the output signals to be provided at the output terminals 84 from the classifier 80. This system 90*a* classifies detected activities as being in either an impact and vibration class or a thermal and force class.

In FIG. 14 a more refined recognition system 100*a* is shown in which four classes of activity are recognized. These are impact, vibration, force and thermal. Recognition system 100*a* is similar to system 90*a* in that it receives its input from adaptive filter system 60*a* and employees filters to recognize waveforms. It differs in that it includes an analog-to-digital converter 01 and uses four digital matched filters 102–105, each of which receives the digitized signal and is designed to recognize or respond to a different one of the four classes of signals. The outputs of those four matched filters 102–105 are coupled to the inputs of four threshold detectors 106–109. Depending on the design of the filters, the threshold function can be included within the digital matched filter if desired by designing it to provide no output unless a response above the threshold level is produced. Each of the matched filters is designed to respond to waveforms in its class with a large output, while being unresponsive to waveforms in the other three classes. Each of these matched filters is designed in accordance with well known techniques to pass or respond to signals of its class while rejecting signals of other classes. The exact design of these matched filters depends on the responses to stimuli which are produced in the environment in which the security system is employed. The waveforms to be matched are determined by installing the transducer or transducers in that environment, developing a set of waveform responses to different stimuli of interest and then assigning similar waveforms to a class. Each filter is then designed to respond to one of those classes. Thus, design of these filters, at least initially, needs to wait until the characteristics of the security system's operational environment have been determined. If greater differentiation among activities is desired, then more matched filters can be added to system 100*a* to provide more signal classes. Matched filters are desirable because they can separately recognize waveforms of two different classes which are superimposed on each other.

Although digital matched filters are preferred because of their versatility, analog matched filters may be used instead. If analog matched filters are used, then the analog-to-digital converter 101 is omitted from the circuit.

Alternatively, a signal processor which recognizes specific waveforms may be used. A waveform recognition system of this type is shown generally at 110*a* in FIG. 15. The recognition system 110*a* comprises a frequency translation system 112 and a waveform recognition system 122. In frequency translation system 112, a low pass filter 114 having a upper cutoff frequency of 3500 Hz receives the output signal from the adaptive filter system 60*a* and provides its own output signal to one input of a mixer 116 whose other input is supplied by a local oscillator 118 whose frequency is 3500 Hz. The output signal from mixer 116 is a 3500 Hz carrier signal having the enhanced transducer signal modulated thereon. This carrier signal is passed through a high pass filter 120 having a sharp cutoff at 3500 Hz to block the lower sideband of the modulated signal and to pass a frequency translated version of the enhanced transducer signal as its output signal. The output signal from high pass filter 120 is provided to the input of the waveform recognition system 122. Waveform recognition system 122, in this embodiment, is preferably a voice recognition system. Such systems are commercially available which have bandwidths which extend from 200 Hz to 7,000 Hz. Interstate Electronics Corporation of 450 Newport Center Drive, Suite 200, Newport Beach, Calif. 92660 sells such systems in a variety of configurations. One of these is the model SYS300. Such systems are also available from other vendors. The voice recognition system 122 is one which the user can train by providing it with sample waveforms during a training period. The system converts these sample waveforms into templates which the voice recognition system compares with received waveforms during the security monitoring process as its means of recognizing waveforms which are characteristic of the particular activities it has been trained to recognize. The output from the voice recognition system is in the form of a signal specifying which of its training waveforms it has identified.

As an alternative to the system 110*a*, a waveform recognition system with a bandwidth running from DC to a frequency of several KHz may be used as the waveform recognition system without need for frequency translation system 112. In that situation, the frequency translation system 112 may be omitted. The waveform recognition system 122 is then connected to receive the output of the adaptive filter system 60*a* directly.

Commercially available voice recognition systems employ digital processing of the signal in order to recognize the trained waveforms. Such digital processing is quite acceptable for use in the security system of this invention. However, analog classification may also be used. The important thing being that the classification system is able to identify the waveforms which are characteristic of the activities of interest.

With the waveform recognition system 110*a* of FIG. 15, maximum differentiation among activities is obtained by "training" the system for each different type of application. First, the system is installed in a particular application. Then, it is set to its training mode and several repetitions of each stimulus of interest are applied to the wall or other boundary to generate a set of reference waveforms which define that stimulus to the waveform recognition system 110*a*. Thus, a number of hammer blows are used to compile a reference "hammer" waveform and so forth. This training process can parallel the process of training a speech recognition system to recognize the voices of a number of different people.

The process of training the waveform recognition system has a strong effect on the system's ability to recognize waveforms. Thus, if the classification system has difficulty in recognizing some activities of interest, then additional training may be required in order to enable it to distinguish between two different stimuli which induce similar waveforms or to add an additional waveform to its "vocabulary" when an unanticipated stimulus is found to recur with sufficient frequency to justify such an addition. To this end, it is desirable that the recognition system provide an output signal indicating that an unclassifiable signal has been received whenever no individual signal is recognized despite the presence of a received signal having a sufficient amplitude to indicate that some stimulus is present.

In FIG. 8, each of the transducers 31–36 is shown as covering only a portion of the surface on which it is disposed. For maximum security it is preferable to have the transducers cover the entire surface on which they are disposed. Unfortunately, at this time, large sheets of ferroelectric PVDF are not available. As larger sheets become available, it will be feasible to cover larger surfaces with a single transducer. In the meantime, where it is considered necessary for maximum security, coverage of an entire wall may be provided by mounting a plurality of transducers 10 on the wall in a checkerboard pattern to form an array of transducers. Such an array provides an additional ability to localize an activity to a particular portion of the wall at which the stimulus induces the largest transducer signal. In the case of floor transducers 34, this is also beneficial for the purpose of tracking the path taken by an individual in crossing the room and also enables different portions of the room to be separately monitored.

What is claimed is:

1. A system for sensing activity affecting a secured area or a boundary which defines that secured area, said system comprising:

a transducer including a ferroelectric film of polyvinylidene fluoride (PVDF) with first and second opposed major surfaces having, respectively, first and second electrodes deposited thereon;

said transducer being disposed with its first major surface in acoustic and thermal contact with a portion of said boundary to transduce individual types of thermal and mechanical activity affecting said boundary into electrical signals, each activity of interest being transduced into an electrical signal having a corresponding waveform;

means responsive to the presence of said electrical signals corresponding to said individual activities of interest for separately recognizing the waveforms which correspond to each of at least two different ones of said activities for detecting the occurrence of those at least two different individual activities and for producing an output signal identifying each of said individual activities whose occurrence is detected; and means responsive to said identification signal for generating an alarm signal in response to the identification of specific activities.

2. The system recited in claim 1 wherein each of said first and second electrodes is substantially coextensive with said major surface of said PVDF layer on which it is deposited.

3. The system recited in claim 1 wherein said means responsive to said electrical signals comprises means for separating said electrical signals into relatively high frequency components which are primarily associated with impact and vibration, and into relatively low frequency components which are primarily associated with temperature and force.

4. The system recited in claim 1 wherein said means responsive to said electrical signals comprises matched filters each designed to respond to said electrical signal which corresponds to an individual activity.

5. The system recited in claim 4 wherein one of said matched filters is designed to respond to thermal activity.

6. The system recited in claim 1 wherein said means responsive to said electrical signals comprises a waveform recognition system which is trained to recognize the signals produced by individual activities.

7. The system recited in claim 1 wherein said means for detecting and producing comprises means for determining the intensity of each of said detected individual activities and for providing an output signal which specifies said determined intensity for each of said detected individual activities.

8. The system recited in claim 1 wherein said boundary includes a major surface and said transducer is disposed on said major surface of said boundary.

9. The system recited in claim 1 wherein said boundary has a major surface on which said transducer is disposed and said transducer is substantially coextensive with said major surface of said boundary on which it is disposed.

10. The system recited in claim 1 wherein a first one of said at least two different activities involves pressure on the boundary and a second one of said two different activities involves a change in the temperature of at least part of said boundary.

* * * * *